US006373038B2

(12) United States Patent
Han et al.

(10) Patent No.: US 6,373,038 B2
(45) Date of Patent: Apr. 16, 2002

(54) MICROWAVE OVEN HAVING A ROTATING TRAY SUPPORT

(75) Inventors: Yong-woon Han, Kunpo; Seong-deog Jang; Kwang-seok Kang, both of Suwon; Dae-sung Han, Kyungki-do; Jin-ho Kim, Suwon; Han-seong Yoo, Yongin; Han-sung Kang, Suwon, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/774,679

(22) Filed: Feb. 1, 2001

(30) Foreign Application Priority Data

Mar. 31, 2000 (KR) ..... 00-17030

(51) Int. Cl.[7] ..... H05B 6/78
(52) U.S. Cl. ..... 219/754; 219/762
(58) Field of Search ..... 219/754, 753, 219/755, 762; 108/20, 139

(56) References Cited

U.S. PATENT DOCUMENTS 4,501,945 A * 2/1985 Arabori et al. ..... 219/754
4,591,682 A * 5/1986 Takeuji ..... 219/754
4,631,379 A * 12/1986 Aoyama ..... 219/754
5,463,207 A * 10/1995 Kang ..... 219/754
5,892,209 A * 4/1999 Choi ..... 219/754

FOREIGN PATENT DOCUMENTS

JP 52-27388 * 6/1977
JP 9-189426 * 7/1977 ..... 219/754

* cited by examiner

*Primary Examiner*—Philip H. Leung
(74) *Attorney, Agent, or Firm*—Robert E. Bushnell, Esq.

(57) ABSTRACT

Disclosed is a microwave oven having a tray which is arranged in a cooking chamber and on which a food to be cooked or a vessel having accommodated therein a food to be cooked is placed and a tray driving section which is disposed in a driving chamber for transferring rotating force to the tray. The microwave oven includes a tray supporting unit for preventing the tray from being released from an original installation position. The tray supporting unit includes a first coupling portion which is formed on a driving shaft of the tray driving section, a second coupling portion which is press-fitted around the first coupling portion, and supporting arm portions which extend from the second coupling portion in a radial direction so as to be respectively engaged with an edge of the tray.

20 Claims, 5 Drawing Sheets

MICROWAVE OVEN HAVING A ROTATING TRAY SUPPORT

CLAIM OF PRIORITY

This application makes reference to, incorporates the same herein, and claims all benefits accruing under 35 U.S.C. §119 from my application entitled MICROWAVE OVEN filed with the Korean Industrial Property Office on Mar. 31, 2000 and there duly assigned Serial No. 2000/17030.

BACKGROUND OF THE INVENTION

1. Field of the Invention

The present invention relates to a microwave oven, and more particularly, to a microwave oven which can prevent a tray from being released from an original installation position due to vibration, impact, inclination or the like in the case that the microwave oven is equipped to mobile means such as a motor vehicle, etc.

2. Description of the Related Art

Conventionally, since a microwave oven requires utility AC power, the microwave oven has been used in a location where AC power is supplied, such as a kitchen, etc. However, as a dual-purpose microwave oven which can be driven not only by AC power but also by DC power, is recently disclosed in the art, the microwave oven can be conveniently used in an outdoor field as well as the kitchen.

Such a double-purpose microwave oven is shown in FIGS. 1 and 2. Referring to FIGS. 1 and 2, the microwave oven has a cabinet 1. A space inside the cabinet 1 is divided into a cooking chamber 2 in which a food is received to be cooked, and a driving chamber 3 in which a variety of electrical parts for supplying microwaves of a high frequency into the cooking chamber 2 are disposed.

As can be readily seen from FIG. 2, a tray 5 on which a food to be cooked or a vessel having accommodated therein a food to be cooked is placed, and a rotation guide 6 for rotatably 8 supporting the tray 5, are disposed in the cooking chamber 2. In the driving chamber 3, there are disposed a tray driving section 8 for transferring rotating force to the tray 5, a magnetron 9 for supplying the microwaves of a high frequency to the cooking chamber 2, a waveguide 10 for guiding the microwaves of a high frequency, which are generated by the magnetron 9, into the cooking chamber 2, and so forth.

The tray 5 is coupled with a driving shaft 8*a* of the tray driving section 8. The rotation guide 6 has an inserting portion which is defined with an inserting hole and branched portions which are branched from the inserting portion in a radial direction. The inserting hole has an inner diameter which is substantially the same as an outer diameter of the driving shaft 8*a*. The driving shaft 8*a* is inserted through the inserting hole of the inserting portion of the rotation guide 6. A plurality of rollers 7 are provided to free ends of the branched portions, respectively. The plurality of rollers 7 are simultaneously brought into contact with a bottom surface of the cooking chamber 2 and a lower surface of the tray 5.

As a consequence, the microwaves of a high frequency which are generated by the magnetron 9 which is disposed in the driving chamber 3, are supplied into the cooking chamber 2 through the waveguide 10, whereby the food placed on the tray 5 is cooked. At this time, the tray 5 is rotated by the tray driving section 8 in a manner such that the microwaves of a high frequency can be uniformly radiated to portions of the food to be cooked.

However, the conventional microwave oven suffers from defects in that, since the tray 5 is simply seatedly coupled to the driving shaft 8*a* of the tray driving section 8 by self weight, in the case that external force which exceeds the self weight, is applied to the tray 5, the likelihood of the tray 5 to be released from its original installation position, that is, the driving shaft 8*a* of the tray driving section 8, is increased. This problem is worsened in the case that a motor vehicle runs in a state wherein the microwave oven is equipped thereto or the microwave oven is transported from place to place, to cause the microwave oven to experience vibration, impact, inclination or the like. As the tray 5 is released from the original installation position to be collided with a wall defining the cooking chamber 2, a possibility of the cooking chamber 2 or the tray 5 itself to be damaged is increased.

SUMMARY OF THE INVENTION

Accordingly, the present invention has been made in an effort to solve the problems occurring in the related art, and an object of the present invention is to provide a microwave oven which prevents a tray from being released from an original installation position due to vibration, impact, inclination or the like, thereby protecting a cooking chamber and the tray itself from being damaged.

In order to achieve the above object, according to the present invention, there is provided a microwave oven having a tray which is arranged in a cooking chamber and on which a food to be cooked or a vessel having accommodated therein a food to be cooked is placed and a tray driving section which is disposed in a driving chamber for transferring rotating force to the tray, the microwave oven comprising: tray supporting means for preventing the tray from being released from an original installation position, the tray supporting means including a first coupling portion which is formed on a driving shaft of the tray driving section, a second coupling portion which is press-fitted around the first coupling portion and supporting arm portions which extend from the second coupling portion in a radial direction so as to be respectively engaged with an edge of the tray.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Reference will now be made in greater detail to a preferred embodiment of the invention, an example of which is illustrated in the accompanying drawings.

Figure 1:
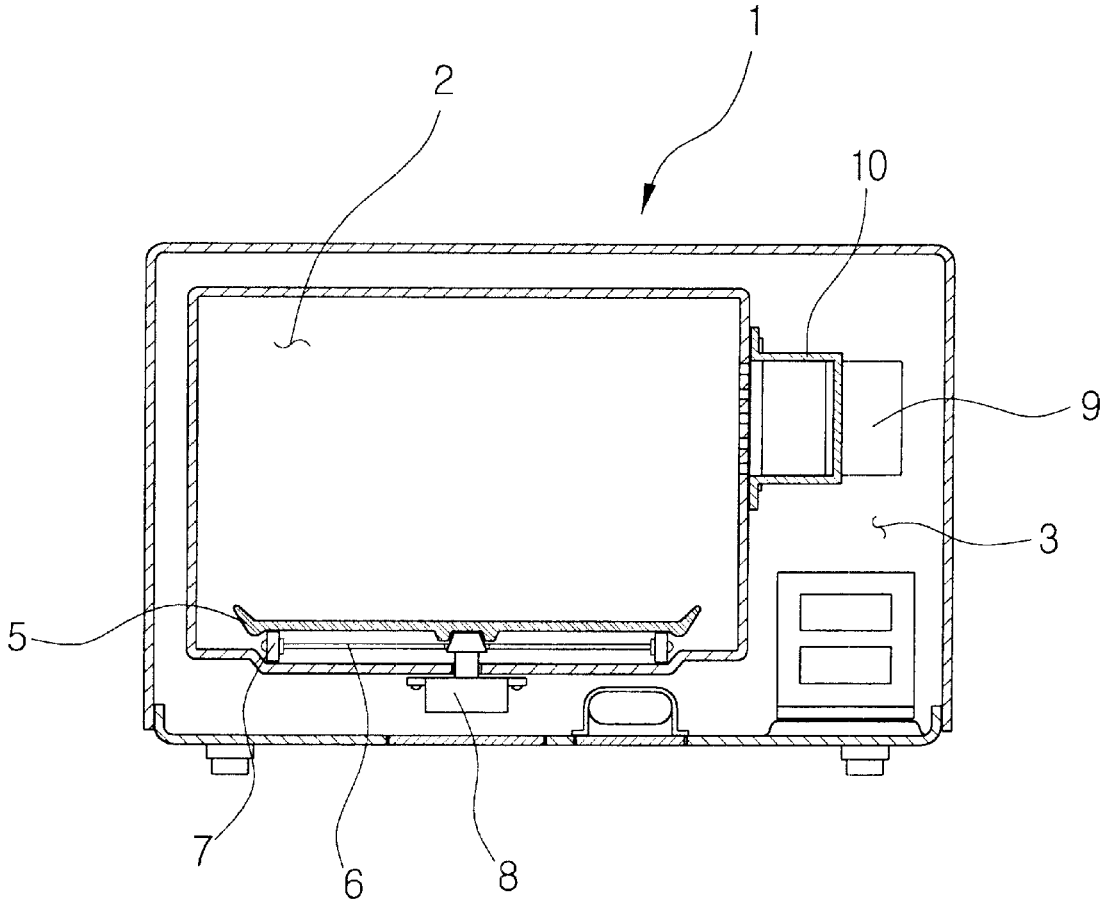
FIG. 1 (PRIOR ART)
FIG. 1 is a cross-sectional view illustrating the conventional microwave oven.
Figure 2:
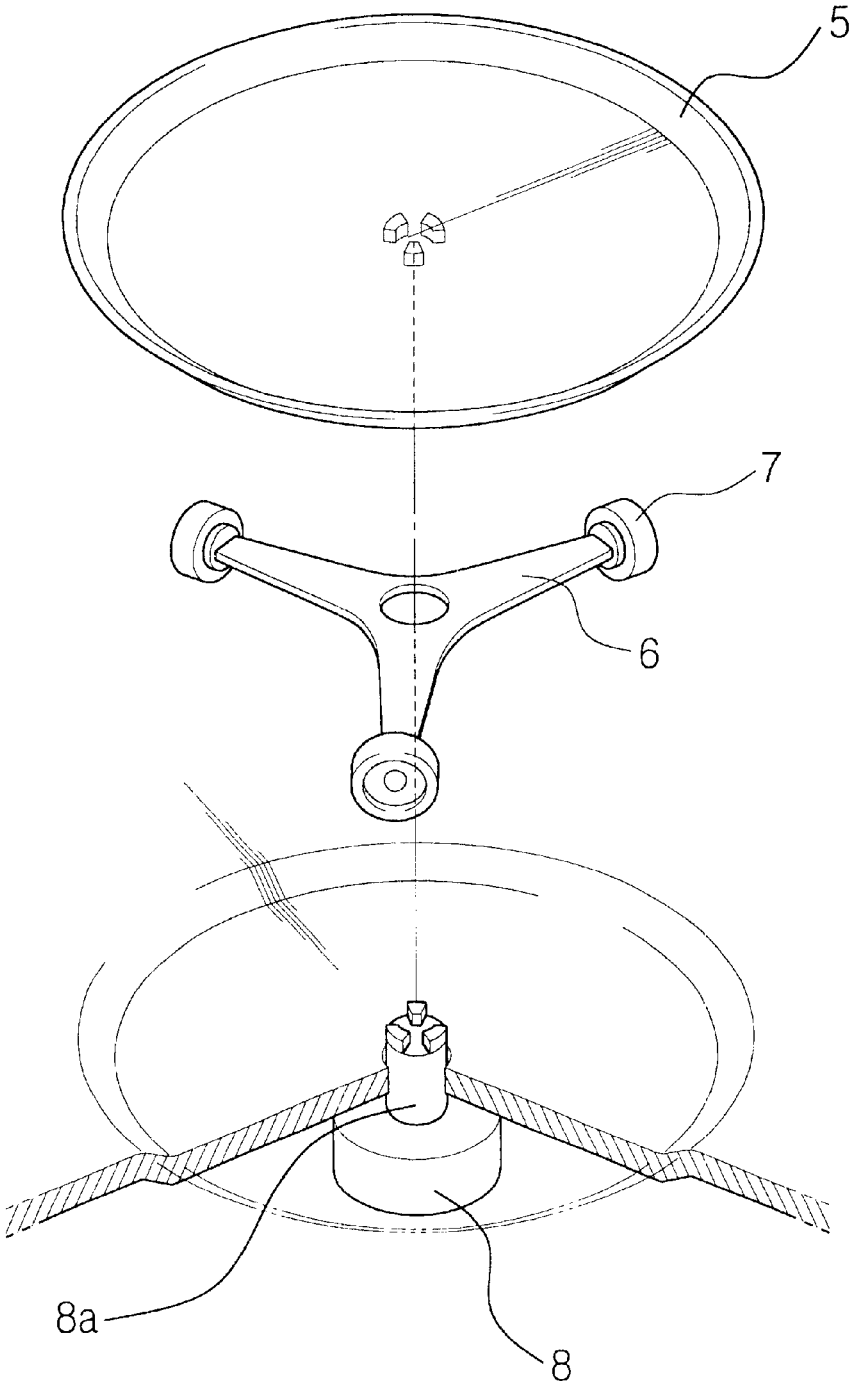
FIG.2 (Prior Art)
FIG. 2 is an exploded perspective view illustrating a tray which is shown in FIG. 1 and a structure associated therewith.
Figure 3:
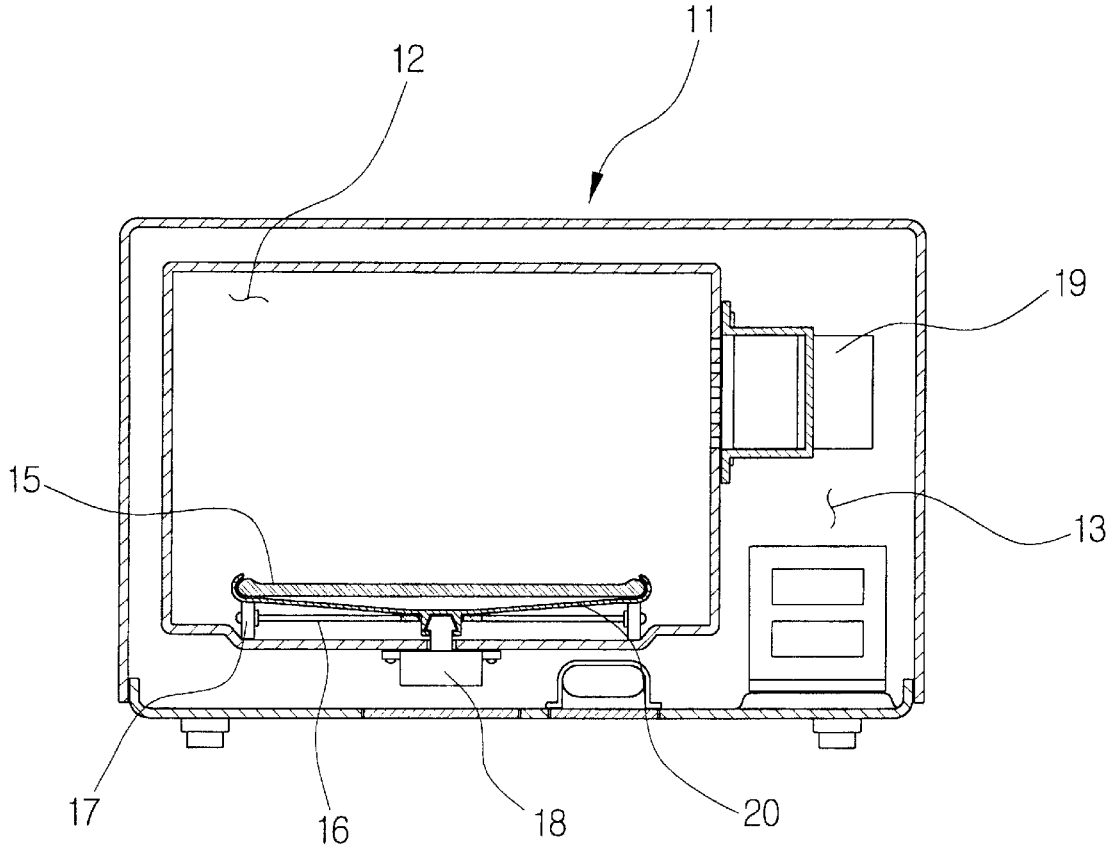
FIG. 3 is a cross-sectional view illustrating a microwave oven in accordance with a first embodiment of the present invention.
Figure 4:
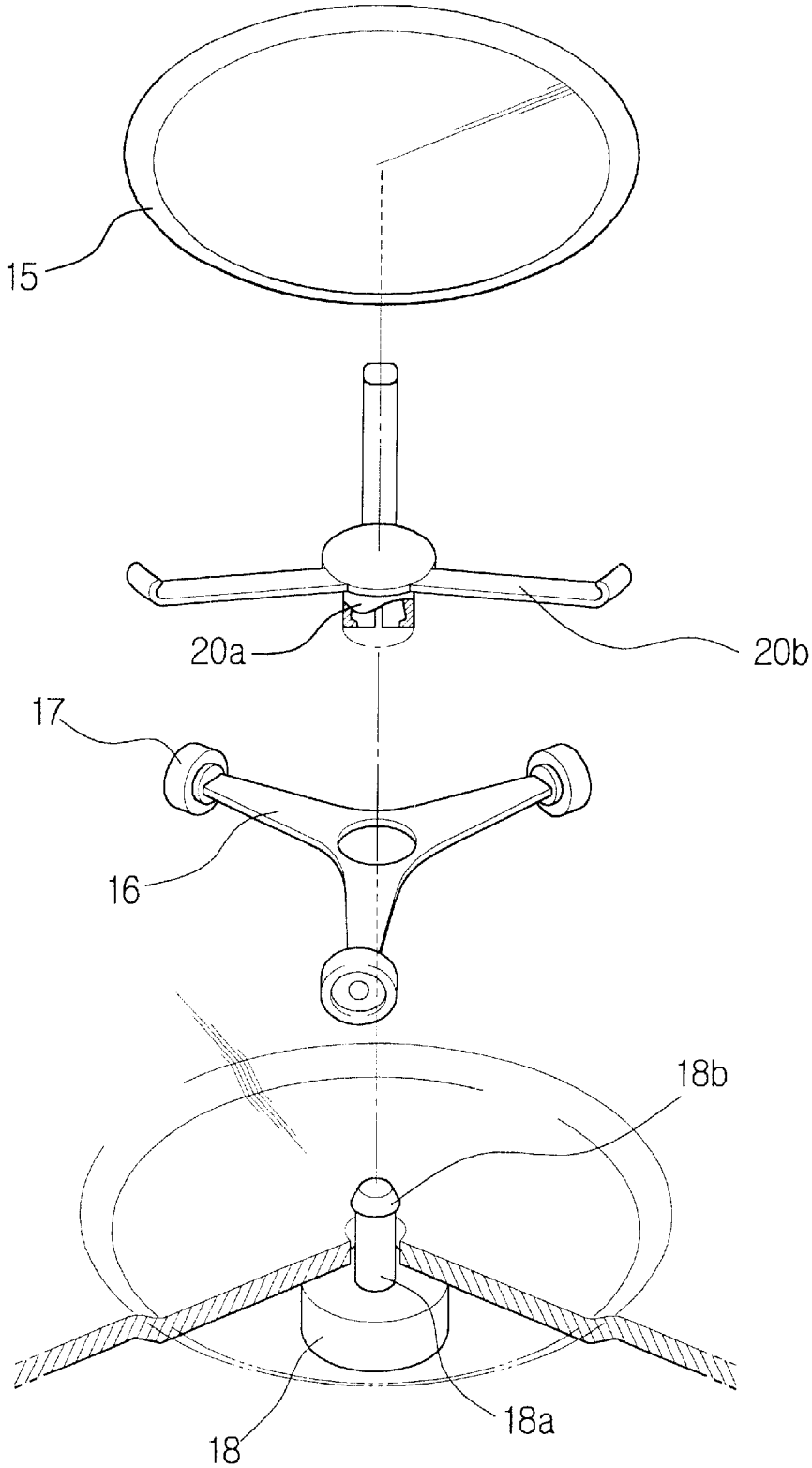
FIG. 4 is an exploded perspective view illustrating the microwave oven according to the first embodiment of the present invention.

Referring to FIGS. 3 and 4, there is illustrated a microwave oven in accordance with a first embodiment of the present invention. In the microwave oven, a tray 15 on which a food to be cooked or a vessel having accommodated therein a food to be cooked is placed, is rotatably arranged in a cooking chamber 12. The microwave oven includes tray supporting means 20 which is disposed in the cooking chamber 12 so as to rotatably support the tray 15 and prevent the tray 15 from being released from its original installation position. A tray driving section 18 for transferring rotating force to the tray 15, a magnetron 19 which cooperates with the tray driving section 18 to cook the food and supplies microwaves of a high frequency into the cooking chamber 12, and so forth, are disposed in a driving chamber 13. A rotation guide 16 for rotatably supporting the tray 15 is disposed below the tray 15 in the cooking chamber 12. The rotation guide 16 has an inserting portion which is defined with an inserting hole and branched portions which are branched from the inserting portion in a radial direction. A plurality of rollers 17 are provided to free ends of the branched portions, respectively. The drawing reference numeral 11 represents a cabinet, a space inside of which is divided into the cooking chamber 12 and the driving chamber 13.

As can be readily seen from the exploded view shown in FIG. 4, the tray supporting means 20 includes a first coupling portion 18*b* which is formed at an upper end of a driving shaft 18*a* of the tray driving section, that is, a tray motor 18, a second coupling portion 20*a* which is press-fitted around the first coupling portion 18*b*, and supporting arm portions 20*b* which extend from the second coupling portion 20*a* in the radial direction so as to be respectively engaged with a circumferential edge of the tray 15.

While the first coupling portion 18*b* and the second coupling portion 20*a* can be coupled or decoupled with or from each other by predetermined external force which is manually applied thereto, the first and second coupling portions 18*b* and 20*a* are configured in a manner such that they cannot be unexpectedly detached from each other by external vibration, external impact or inclination of the microwave oven. For example, if the first coupling portion 18*b* comprises a frusto-conical projection, the second coupling portion 20*a* comprises a frusto-conical groove which is mated with the frusto-conical projection. Otherwise, if the first coupling portion 18*b* comprises a frusto-conical groove, the second coupling portion 20*a* comprises a frusto-conical projection which is mated with the frusto-conical groove. At this time, one of the first coupling portion 18*b* and the second coupling portion 20*a* is defined with at least one slot in the radial direction in a manner such that the corresponding coupling portion 18*b* or 20*a* can be elastically expanded or contracted when the two coupling portions 18*b* and 20*a* are coupled with each other.

It is preferred that the supporting arm portions 20*b* be inclined upward from the second coupling portion 20*a* in such a way as to allow the tray 15 to be supported by the supporting arm portions 20*b* at three or more positions, thereby rendering structural stability. Further, due to the fact that the supporting arm portions 20*b* are formed to have a predetermined elasticity, the supporting arm portions 20*b* can be easily engaged with the circumferential edge of the tray 15.

On the other hand, it is to be noted that the supporting arm portions 20*b* can be respectively engaged with portions of the tray 15 which portions are other than the circumferential edge. For example, in the case that the supporting arm portions 20*b* are engaged with a lower surface of the tray 15, at least three pairs of protrusions can be formed on the lower surface of the tray 15 in a manner such that the three pairs are spaced apart one from another along a circumferential direction and each supporting arm portion 20*b* is detachably engaged with each pair of protrusions. Also, fitting grooves can be defined along a circumference of the second coupling portion 20*a* in a manner such that the supporting arm portions 20*b* are detachably fitted into the fitting grooves of the second coupling portion 20*a*, respectively. Further, the second coupling portion 20*a* can be integrally formed with the rotation guide 16 or can be detachably press-fitted into the inserting hole which is defined in the rotation guide 16. In particular, in the case that the second coupling portion 20*a* is detachably press-fitted into the inserting hole which is defined in the rotation guide 16, the second coupling portion 20*a* and the rotation guide 16 are configured in a manner such that a coupling pattern which is the same as that between the first and second coupling portions 18*b* and 20*a*, is effected.

Figure 5:
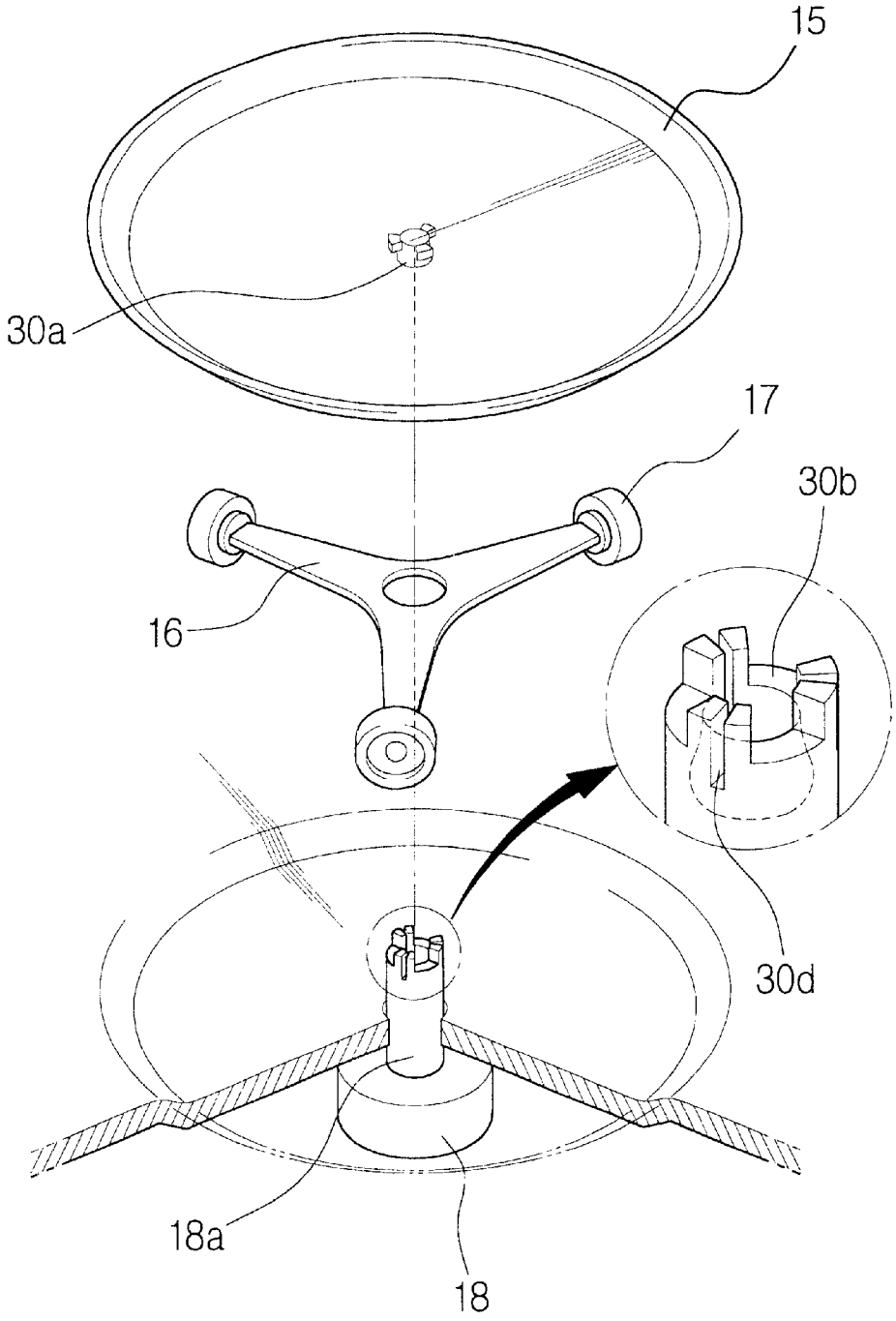
FIG. 5 is an exploded perspective view illustrating a microwave oven in accordance with a second embodiment of the present invention.

Referring to FIG. 5 which illustrates a microwave oven in accordance with a second embodiment of the present invention, tray supporting means includes a first coupling portion 30*a* which is formed at a center portion of the lower surface of the tray 15 and a second coupling portion 30*b* which is formed on the driving shaft 18*a* of the tray driving section 18 in a manner such that the first coupling portion 30*a* is press-fitted into the second coupling portion 30*b*. While, similarly to the first coupling portion 18*b* and the second coupling portion 20*a* of the first embodiment as shown in FIG. 4, the first coupling portion 30*a* and the second coupling portion 30*b* of this second embodiment of the present invention can be coupled or decoupled with or from each other by predetermined external force which is manually applied thereto, the first and second coupling portions 30*a* and 30*b* are configured in a manner such that they cannot be unexpectedly detached from each other by external vibration, external impact or inclination of the microwave oven. Accordingly, if the second coupling portion 30*b* comprises a frusto-conical projection, the first coupling portion 30*a* comprises a frusto-conical groove which is mated with the frusto-conical projection. Otherwise, if the second coupling portion 30*b* comprises a frusto-conical groove, the first coupling portion 30*a* comprises a frusto-conical projection which is mated with the frusto-conical groove. At this time, the present second embodiment of the present invention is differentiated from the construction shown in FIG. 4, in view of the fact that, since the tray 15 is made of an inorganic material such as glass, at least one slot 30*d* is defined in the radial direction only in the second coupling portion 30*b* in a manner such that the second coupling portion 30*b* can be elastically expanded or contracted when the two coupling portions 30*a* and 30*b* are coupled with each other.

While the coupling portions 18*b* and 30*b* respectively shown in FIGS. 4 and 5 can be integrally formed with the driving shaft 18*a* of the tray motor 18, each of them can be formed on a coupling which is fixedly joined with the driving shaft 18*a* of the tray motor 18. Furthermore, while the coupling portions 18*b* and 20*a*; and 30*a* and 30*b* are not unexpectedly detached from each other by external vibration, external impact or inclination of the microwave oven, they are configured in a manner such that they can be decoupled from each other when predetermined external force capable of manually decoupling them from each other is applied thereto.

As a result, by the microwave oven according to the present invention, advantages are provided in that, since tray supporting means for rotatably supporting a tray on which a food to be cooked or a vessel having accommodated therein a food to be cooked is placed, is disposed, the tray is prevented from being released from an original installation position due to vibration, impact, inclination or the like while the microwave oven is equipped to and thereby is used in a motor vehicle or the microwave oven is transported from place to place. Consequently, it is possible to protect a cooking chamber and the tray itself from being damaged due to the release of the tray.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A microwave oven having a tray which is arranged in a cooking chamber and on which a food to be cooked or a vessel having accommodated therein a food to be cooked is placed and a tray driving section which is disposed in a driving chamber for transferring rotating force to the tray, the microwave oven comprising:

tray supporting means for preventing the tray from being released from an original installation position, the tray supporting means including a first coupling portion which is formed on a driving shaft of the tray driving section, a second coupling portion which is press-fitted around the first coupling portion and supporting arm portions which extend from the second coupling portion in a radial direction so as to be respectively engaged with an edge of the tray.

2. The microwave oven as claimed in claim 1, further comprising:

a rotation guide interposed between the first and second coupling portions, the rotation guide having a plurality of rollers.

3. The microwave oven as claimed in claim 2, wherein the rotation guide is defined with an inserting hole through which the second coupling portion is inserted.

4. The microwave oven as claimed in claim 2, wherein the rotation guide is integrally formed with the second coupling portion.

5. The microwave oven as claimed in any one of the claims 1, 2 or 4, wherein the supporting arm portions are engaged with the edge of the tray at three or more positions.

6. A microwave oven having a cooking chamber, comprising:

a motor having a shaft;

a tray disposed within said cooking chamber, having a rim formed on a peripheral side of said tray;

a first coupler formed on said shaft; and a support disposed between said motor and said tray, having a second coupler coupled to said first coupler, having a plurality of arms radially and outwardly extended from said second coupler; and a plurality of distal ends each formed on each of said arms and bent upwardly and then inwardly from said each end portion of said arms, each having an inner curved surface conforming in shape to said rim of said tray, said distal ends holding said rim of said tray to prevent said tray from being released from said shaft when said rim of said tray is inserted into said distal ends of said arms.

7. The microwave oven of claim 6, wherein said second coupler, said arms, and said distal ends of said support are integrally formed in a single body.

8. The microwave oven of claim 6, wherein said second coupler, said arms, and said distal ends of said support are made in a monolithic structure.

9. The microwave of claim 6, with said first coupler having a shape of a frustum while said second coupler having a second shape corresponding to said first coupler inserted into and held by said second coupler.

10. The microwave oven of claim 6, with said distal ends having a shape corresponding to said rim fitted into said distal ends, each distal end raised from respective arms and bent inwardly toward an axis passing through a center of said support.

11. The microwave oven of claim 6, with said distal ends of said arms disposed around respective portions of said rim to hold said rim in a direction to said shaft of said motor when all of said respective portions of said rim are wrapped by said distal ends of said arms.

12. The microwave oven of claim 6, further comprising a guide disposed between said motor and said support, said guide including a central portion having a hole accommodating insertion of one of said first coupler and said second coupler, said guide having a plurality of extensions extended from said central portion, said guide having a plurality of rollers connected to respective extensions.

13. The microwave oven of claim 12, wherein said guide and said second coupler are formed in a single body.

14. The microwave oven of claim 12, with said extensions of said guide each disposed between adjacent arms of said support.

15. The microwave oven of claim 12, with said rollers freely rotating between said tray and a bottom of said cooking chamber while said tray rotates by the coupling between said first coupler of said shaft and said second coupler of said support.

16. The microwave oven of claim 12, wherein said rollers contact a bottom of said tray while said distal ends of said arms wrap said respective portion of said rim of said tray.

17. The microwave oven of claim 12, with said roller freely rotating between said tray and a bottom of said cooking chamber while said tray rotates by the coupling between said rim of said tray and said distal ends of said support.

18. A microwave oven having a cooking chamber, comprising:

a motor having a shaft;

a tray disposed within said cooking chamber, having a rim formed on a peripheral side of said tray;

a support disposed between said motor and said tray, said support having a coupling element formed on a central portion of said support and coupled to said shaft of said motor;

a plurality of arms each radially and outwardly extended from said coupling element; and a plurality of distal ends being bent upwardly and then inwardly from respective arms to form a groove conforming in shape to said rim of said tray, said distal ends of said support holding said rim of said tray when said rim of said tray is inserted into said distal ends.

19. This microwave oven of claim 18, further comprises a roller assembly disposed between said support and a bottom of said cooking chamber, having rollers disposed between said arms of said support to contact both said tray and said bottom of said cooking chamber.

20. The microwave oven of claim 19, with said roller assembly freely rotating while said tray rotates about said cooking chamber by the coupling between said rim of said tray and said distal ends of said support.

* * * * *